US008209815B2

(12) United States Patent
Makarov et al.

(10) Patent No.: US 8,209,815 B2
(45) Date of Patent: Jul. 3, 2012

(54) DUAL STAGE CYCLONIC DUST COLLECTOR

(75) Inventors: Sergey Makarov, Solon, OH (US); Mark Cipolla, Chardon, OH (US); Robert Salo, Mentor, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 650 days.

(21) Appl. No.: 12/330,357

(22) Filed: Dec. 8, 2008

(65) Prior Publication Data

US 2010/0139033 A1 Jun. 10, 2010

Related U.S. Application Data

(60) Provisional application No. 60/992,935, filed on Dec. 6, 2007.

(51) Int. Cl.
*A47L 9/10* (2006.01)

(52) U.S. Cl. ..... 15/352; 15/345; 15/353

(58) Field of Classification Search ..... 15/345, 15/352, 353

See application file for complete search history.

(56) References Cited

U.S. PATENT DOCUMENTS

| | | | | |
|---|---|---|---|---|
| 6,238,451 | B1 | 5/2001 | Conrad et al. | |
| 6,607,572 | B2 * | 8/2003 | Gammack et al. | 55/343 |
| 7,655,058 | B2 * | 2/2010 | Smith | 55/349 |
| 2006/0048487 | A1 * | 3/2006 | Song et al. | 55/343 |
| 2006/0123590 | A1 | 6/2006 | Fester et al. | |
| 2007/0209339 | A1 | 9/2007 | Conrad | |
| 2007/0266678 | A1 | 11/2007 | Makarov et al. | |
| 2008/0289139 | A1 * | 11/2008 | Makarov et al. | 15/350 |
| 2009/0205162 | A1 * | 8/2009 | Oh et al. | 15/353 |

OTHER PUBLICATIONS

International Search Report and Written Opinion for corresponding International Application No. PCT/US08/85926 mailed on Feb. 4, 2009.

* cited by examiner

*Primary Examiner* — Lee D Wilson
*Assistant Examiner* — Shantese McDonald
(74) *Attorney, Agent, or Firm* — Michael Best & Friedrich LLP

(57) ABSTRACT

A surface cleaning suction type appliance comprises a housing, an airstream suction source, a cyclone main body, and a dirt cup. The housing includes a main suction opening. The airstream suction source is mounted to the housing and includes a suction airstream inlet and a suction airstream outlet. The suction source selectively establishes and maintains a flow of air from the main suction opening, via the airstream inlet, to the airstream outlet. The cyclone main body is supported by the housing and is in communication with the main suction opening. The cyclone main body has a uniform outer circumference and includes a first stage separator, and a plurality of downstream second stage separators. The lengths of the second stage cyclonic separators are different for any number of adjacent pairs of separators from on pair up to all adjacent pairs of separators. The dirt cup is connected to the cyclone main body. The dirt cup includes a first particle collector and a second particle collector. The first particle collector communicates with the first stage separator for collecting dust particles from the first stage separator. The separate second particle collector communicates with the plurality of second stage separators for collecting dust particles from the second stage separators.

17 Claims, 15 Drawing Sheets

SECTION A-A

SECTION B-B

SECTION F-F

SECTION C-C

SECTION D-D

SECTION E-E

DUAL STAGE CYCLONIC DUST COLLECTOR

CROSS-REFERENCE TO RELATED APPLICATIONS

This application claims priority to U.S. provisional application Ser. No. 60/992,935 filed Dec. 6, 2007.

The present disclosure relates to suction type surface cleaning appliances and more particularly to such appliances with cyclonic cleaning action for suction type cleaners having a dual stage cyclonic dust collector for suctioning dirt and debris from carpeted surfaces, other floor surfaces like hard floor surfaces, and surfaces of furniture and the like.

TECHNICAL CONSIDERATIONS

Floor care appliances of the suction action cleaning type are well known in the art. Such cleaners commonly referred to as vacuum cleaners are available in a variety of forms such as upright, canister, hand-held or stationary, or built into a house. Moreover, cyclonic designs have also been used on such floor care appliances as carpet extractors and "shop" type vacuum cleaners. In a typical suction or vacuum cleaner, a suction source generates the suction required to pull dirt from the carpet or floor being vacuumed through a suction opening and into a filter bag or a dust cup housed within the vacuum cleaner. After multiple uses of the vacuum cleaner, the filter bag must be replaced or the dust cup emptied.

To avoid the need for vacuum filter bags, and the associated expense and inconvenience of replacing the filter bag, another type of vacuum cleaner utilizes cyclonic air flow and perhaps one or more multi-use filters, rather than a replaceable filter bag, to separate the dirt and other particulates from the suction air stream. If filters are used, they would need infrequent replacement.

While some currently available cyclonic air flow vacuum cleaner designs and constructions are acceptable for many common types of dust and dirt materials in many situations, the need exists for continued improvements and alternative designs for such vacuum cleaners for improvement on cleaning efficiency for more of the various types of debris that need cleaned. Also it is desirable to simplify assembly and improve filtering and dirt removal. The cyclonic air flow can be generated from a single stage cyclonic separator or a multi-stage cyclonic separator. One challenge regarding the design of a multi-stage cyclonic separator unit is the dust collector, which needs to be compact and easily serviceable by the user. The dust collector generally includes a first cyclonic separator, a plurality of second cyclonic separators and at least one particle collector. The position of the second or plurality of second stage cyclonic separators poses additional design concerns. For instance, the second stage cyclones can be positioned above the first cyclone. However, this can increase the overall height of the dust collector, which is especially disadvantageous for canister vacuum cleaners. Alternatively, the second stage cyclones can be positioned around the first cyclone to form a separate, second particle collector. However, this can increase the overall width of the particle collector, which is especially disadvantageous for upright vacuum cleaners. Also, with such a design, the diameter of the first particle collector remains relatively small, which is disadvantageous from the standpoint of separation efficiency. As another alternative, the second stage cyclones can be positioned inside and at least partially below a top wall of the first cyclone. However with such a design, the second cyclones are hidden and difficult to service due to lack of access.

Therefore, while some prior art cyclonic air flow suction type cleaner designs and constructions are acceptable for cleaning many types of common dirt and dust in many instances, the need exists for continued improvements and alternative designs for such vacuum cleaners. For example, it would be desirable to simplify assembly, improve filtering and dirt removal, and allow easier maintenance of such suction type surface cleaners.

Accordingly, the present disclosure provides an improved dual stage cyclonic air flow design which overcomes certain difficulties with the prior art designs while providing better and more advantageous overall results.

SUMMARY OF THE DISCLOSURE

In accordance with one aspect of the present disclosure, a dual stage cyclone dust collector for a suction type surface cleaner comprises a first upstream cyclonic In accordance with the present invention, a dual stage cyclone dust collector for a vacuum cleaner comprises a first upstream cyclonic separator for separating dust from dust-laden air and a plurality of downstream second cyclonic separators for separating remaining dust particles from air which has been partially cleaned by the first separator. Adjacent ones of the downstream separators have differing lengths. A first particle collector communicates with the first separator for collecting coarse dust particles. A second particle collector communicates with the second separators for collecting fine dust particles. The two particle collectors can be individually emptied.

Still other aspects of the invention will become apparent from a reading and understanding of the detailed description of the several embodiments described hereinbelow.

DETAILED DESCRIPTION

It should, of course, be understood that the description and drawings herein are merely illustrative and that various modifications and changes can be made in the structures disclosed without departing from this disclosure. Like numerals refer to like parts throughout the several views. It will also be appreciated that the various identified components of the dual cyclonic dust collector disclosed herein are merely terms of art that may vary from one manufacturer to another and should not be deemed to limit the present invention. It should be appreciated that the dual cyclonic dust collector can be adapted for use with a variety of household cleaning appliances, such as upright cleaners, carpet extractors, bare floor cleaners, "shop" type cleaners, canister cleaners, hand-held cleaners and built-in units. Moreover, the design could also be adapted for use with robotic units, which are becoming more widespread.

Figure 1:
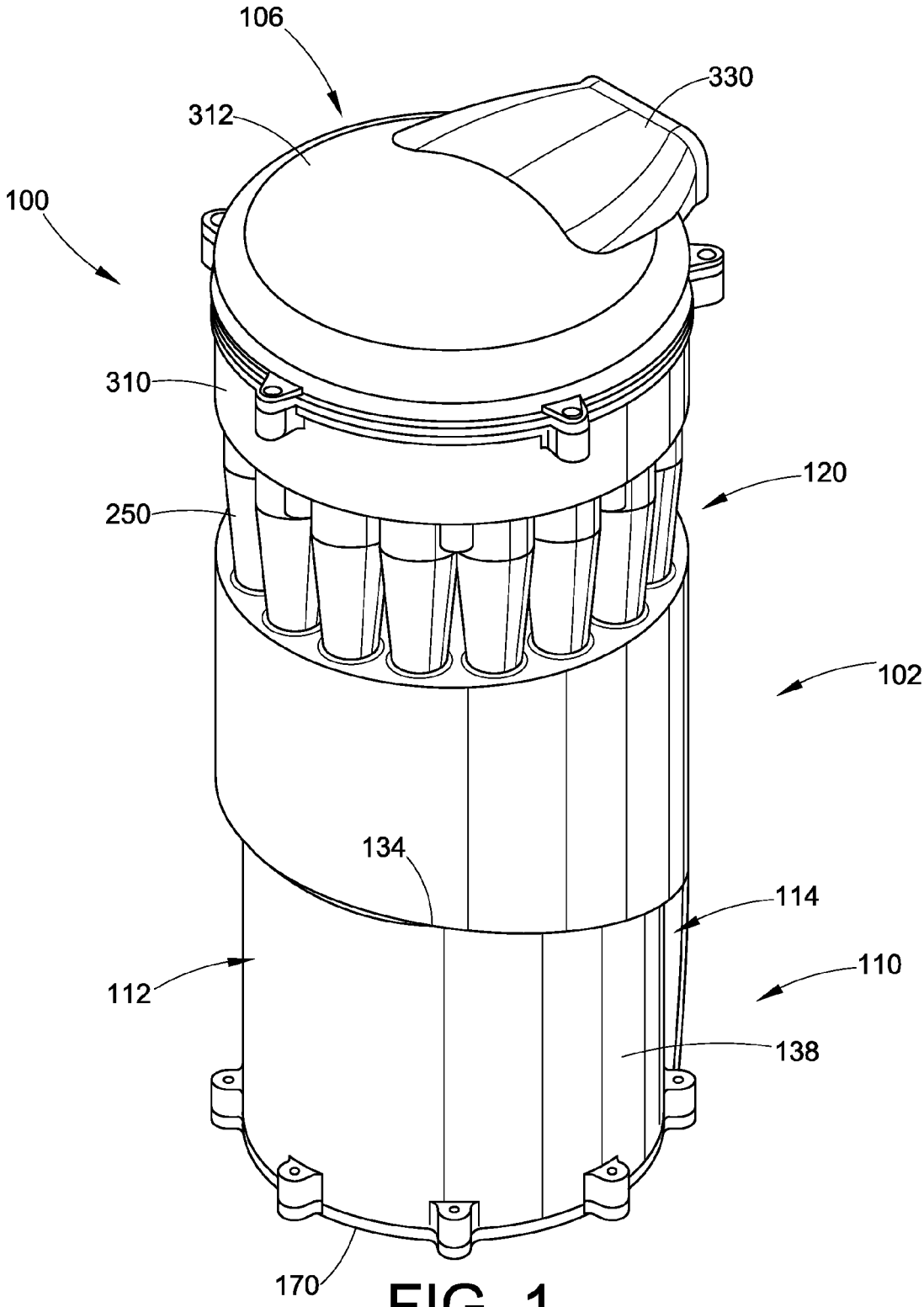
FIG. 1 is a front perspective view illustrating a dual cyclonic dust collector for a vacuum cleaner in accordance with one aspect of the present invention.
Figure 2:
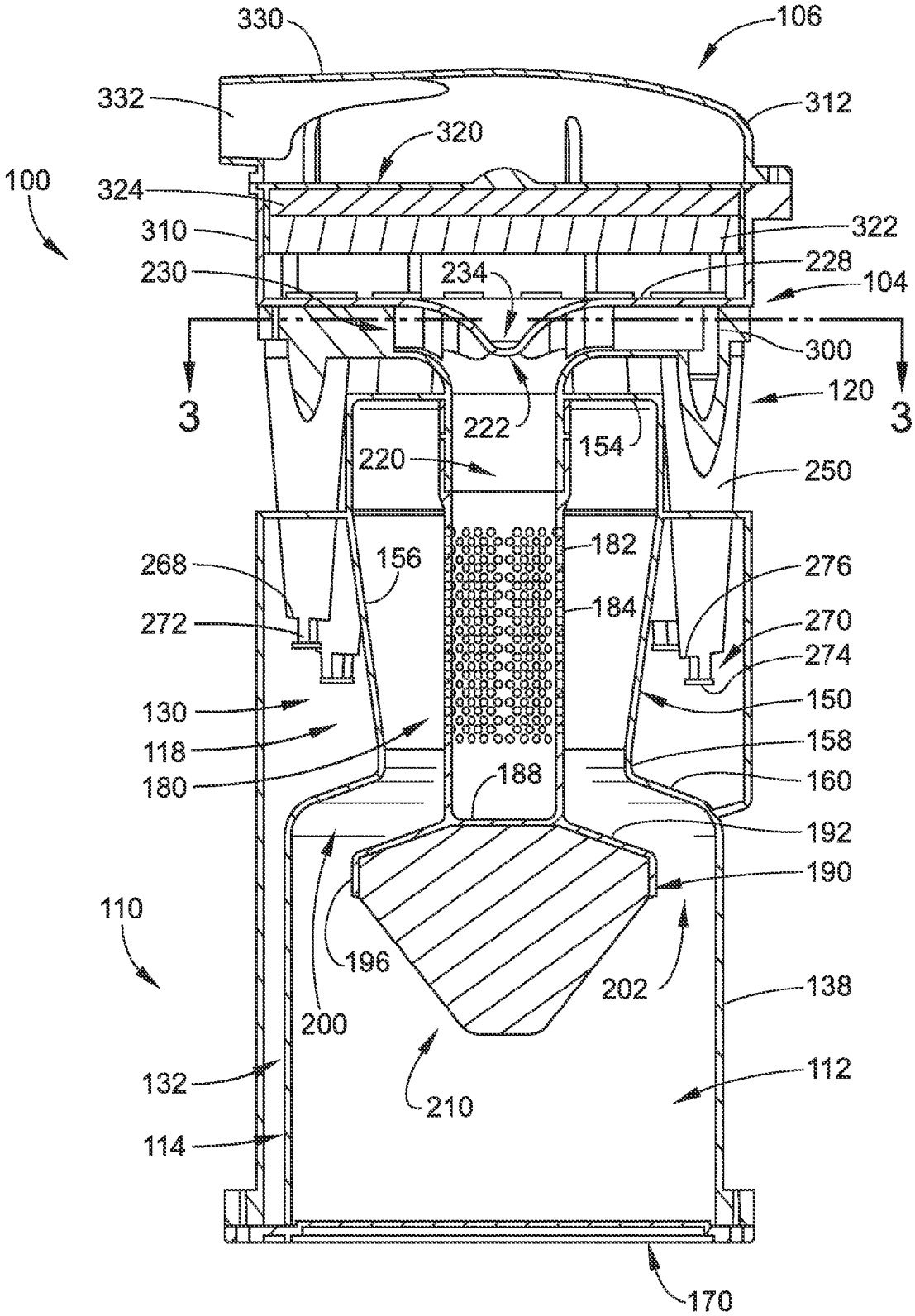
FIG. 2 is a cross-sectional view of the dust collector of FIG. 1.

Referring now to the drawings, wherein the drawings illustrate several embodiments of the present invention only and are not intended to limit same, FIGS. 1 and 2 illustrate a dual cyclonic dust collector 100 according to one aspect of the present invention. The dust collector 100 includes a cyclone main body 102, an air manifold 104 and cover unit 106 attached to an upper portion of the cyclone main body, and a dirt cup 110 connected with a lower portion of the cyclone main body.

The dirt cup 110 includes a first dust collection chamber 112 and a second dust collection chamber 114. The cyclone main body 102 includes a first cyclone part or first cyclonic stage 118 and a second cyclone part or second cyclonic stage 120. As will be described in greater detail below, the first and second dust collection chambers are configured to independently store dirt and dust particles separated by the respective first and second cyclone parts. The dirt cup 110 and the cyclone main body 102 can be made of a transparent material so that the presence of dirt can be seen in the dust collector 100.

As shown in FIG. 2, the second dust collection chamber 114 includes an upper collection section 130 in communication with a lower collection section 132. The upper collection section generally surrounds a portion of the first cyclone part 118. A bottom portion 134 of the upper collection section 130 is tapered to promote sliding of the remaining dust particles separated by the second cyclone part 120 from the upper collection section 130 into the lower collection section 132. The lower collection section extends outwardly from a sidewall 138 of the first dust collection chamber 112. As shown in FIG. 1, because the lower collection section 132 only partially surrounds the first dust collection chamber 112, visibility of the sidewall 138 of the first dust collection chamber is not affected by fine dust particles collected in the second dust collection chamber 114. The first and second dust collection chambers can be completely separated from each other such that the airflow in one of the chambers does not affect the airflow in the other of the chambers. This further improves the dust collection efficiency of the dust collector 100. Nonexclusive examples of this relationship are shown in copending and published patent application entitled, "DUAL STAGE CYCLONIC VACUUM CLEANER" Ser. No. 12/125,505, filed May 22, 2008.

The first cyclone part 118 comprises a generally frustoconically shaped first stage cyclone separator 150. Alternatively, the separator 150 could have a generally cylindrical shape. The first stage separator includes a dirty air inlet conduit 152 (FIG. 3), a top wall 154 and a sidewall 156 having an outer surface and an inner surface. A lower end 158 of the first stage cyclone separator is secured to a lower skirt 160. The dirty air inlet conduit 152 is in fluid communication with a nozzle assembly (not shown), which can include a brushroll, of a vacuum cleaner. The dirty air inlet conduit can be generally rectangular in cross-section and can have a varying cross-sectional dimension which allows the air stream to be drawn into the first stage separator 150 by way of the venturi effect, which increases the velocity of the air stream and creates an increased vacuum in the separator dirty air inlet. For example, the dirty air inlet conduit 152 can include a decreasing cross-sectional area. Alternatively, the dirty air inlet conduit can transition from a rectangular cross-sectional area into, for example, a round discharge opening.

The airflow into the first stage separator 150 is tangential which causes a vortex-type, cyclonic or swirling flow. Such vortex flow is directed downwardly in the first stage separator by the top wall 154. Cyclonic action in the first stage separator 150 removes a substantial portion of the entrained dust and dirt from the suction air stream and causes the dust and dirt to be deposited in the first dust collection chamber 112 of the dirt cup 110. As shown in FIG. 2, the lower skirt 160 is integrally formed with an upper portion of the sidewall 138 of the first dust collection chamber 112. Although, it should be appreciated that the lower skirt can be secured to the first dust collection chamber via other conventional means.

Pivotally secured to a lower portion of the dirt cup 110 can be a bottom plate or lid 170, although other emptying constructions could also be employed. For instance those shown in copending and published patent application entitled "Separately Opening Dust Containers" Ser. No. 11/607,362 filed Dec. 1, 2006 can be used. A pivotable bottom lid allows for emptying of the first and second dust collection chambers 112 and 114, respectively. A seal ring (not shown) can be fitted around the bottom lid to create a seal between the bottom lid and the dirt cup 110. A hinge assembly (not shown) can be used to mount the bottom lid 170 to a bottom portion of the dirt cup. The hinge assembly allows the bottom lid to be selectively opened so that dirt and dust particles that were separated from the air stream by the first and second stage cyclones 118 and 120, respectively, can be emptied from the first and second dust collection chambers. A latch assembly (not shown) can be located diametrically opposed from the hinge assembly 142. Normally, the latch assembly maintains the bottom lid 170 in a closed position.

It should be appreciated that the bottom lid 170 can be configured to only allow for emptying of the first dust collection chamber 112, which requires emptying more frequently than the second collection chamber 114. In this case, a separate second bottom lid (not shown) can be hingedly mounted to the bottom portion of the dirt cup 110 to allow for independent emptying of the second dust collection chamber 114. A separate hinge assembly and latch assembly can be operably connected to such a second bottom lid. The separate hinge assembly would allow the second bottom lid to be independently, selectively, opened so that remaining dirt and dust particles that were separated from the air stream by the second cyclone part 120 can be emptied from the second dust collection chamber 114. Each bottom lid can include a device to delay the opening of the bottom lid and/or moderate movement of the bottom lid, causing the bottom lid, on release from its closed position, to be opened smoothly yet steadily and slowly. This delayed or slowed movement prevents the dirt collected in each collection chamber 112, 114 from being reintroduced into ambient air. The device can include conventional damping devices, such as a spring, piston and the like, and/or a mechanism integrated in each bottom lid or the dirt cup.

With continued reference to FIG. 2, fluidly connecting the first cyclone part 118 to the second cyclone part 120 is a perforated tube 180. The perforated tube is disposed within the first stage separator 150 and extends longitudinally therein. In the depicted embodiment, the perforated tube 180 has a longitudinal axis coincident with the longitudinal axes of the first stage separator 150 and the first dust collection chamber 112, thereby creating a central air path. However, it should be appreciated that the respective axes can be spaced from each other. The perforated tube includes a generally cylindrical section 182. A plurality of openings or perforations 184 is located around a portion of the circumference of the cylindrical section. Such a perforated tube is useful for removing threads and fibers from the air stream which flows towards the second cyclonic stage. As might be expected, the diameter of the openings 184 and the number of those openings within the perforated tube 180 directly affect the filtration process occurring within the dirt cup 110. Also, additional openings result in a larger total opening area and thus the airflow rate through each opening is reduced. Thus, there is a smaller pressure drop and lighter dust and dirt particles will not be as likely to block the openings. The openings 184 serve as an outlet from the first stage separator 150, allowing the partially cleaned fluid to enter the second cyclone stage 120. It can be appreciated that the perforated tube can be made removable from the dust collector 100 for cleaning purposes.

The perforated tube 180 can also include at least one fin (not shown) mounted to an inside surface of the cylindrical section 182 and extending generally longitudinally through the perforated tube. The at least one fin serves to reduce or eliminate cyclonic flow inside the perforated tube.

Connected to a lower, closed end 188 of the perforated tube is a shroud 190 for retarding an upward flow of dirt and dust particles that have fallen below the lower end 158 of the first stage separator 150. The shroud has an outwardly flared section 192 and a flange 196 extending downwardly from the flared section. As is best illustrated in FIG. 2, a diameter of the shroud, particularly an end of the outwardly flared section, can be approximately equal to a diameter of the separator lower end 158 but is preferably larger in diameter than the lower end of the separator. Also, an inside diameter of the first dust collection chamber 112 is substantially larger than the diameter of the separator lower end. This retards dust from being picked up by flow of air streaming from the first dust collection chamber 112 toward the openings 184 of the perforated tube 180. The flared section 192 of the shroud 190, which is generally parallel to the lower skirt 160, and the lower skirt define a first air channel 200. The shroud flange 196, which is generally parallel to the first dust collection chamber sidewall 138, and the sidewall define a second air channel 202. The first and second air channels direct air from the first stage separator 150 into the first dust collection chamber 112. The first air channel and the second air channel can have a substantially constant volume for maintaining airflow velocity. Also, the volume of the first air channel can be approximately equal to the volume of the second air channel.

A laminar flow member, such as one or more baffles or fins 210, is mounted to the closed lower end 188 of the perforated tube 180. At least a portion of the laminar flow member is encircled by the shroud 190. The laminar flow member extends generally along a longitudinal axis of the perforated tube and partially into the first dust collection chamber 112. The baffles 210 can be cruciform in shape and include a cross blade assembly, which can be formed of two flat blade pieces that are oriented approximately perpendicular to each other. It should be appreciated that the baffles may be formed of various shapes. For example, if a blade is employed, it can have a rectangular shape, a triangular shape or an elliptical shape, when viewed from its side. Also, in addition to a cross blade design, other designs are also contemplated. Such designs can include blades that are oriented at angles other than normal to each other or that use more than two sets of blades. The blades can be twisted along their length if so desired, as this may reduce the noise generated by the vacuum cleaner's cyclonic operation. These baffles can assist in allowing dirt and dust particles to fall out of the air stream between the perforated tube lower end and the bottom lid 170 of the first dust collection chamber 112.

Figure 3:
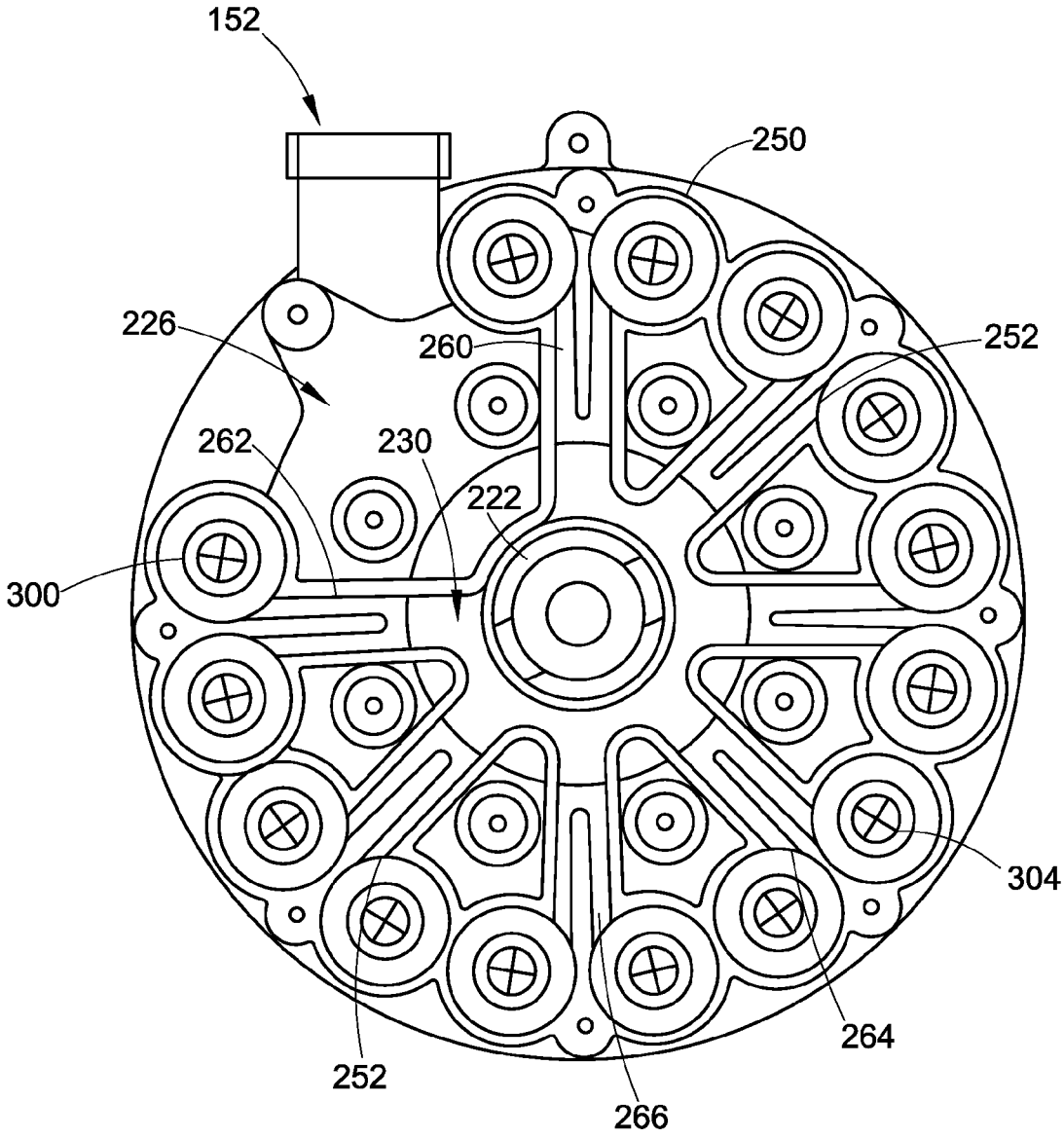
FIG. 3 is a cross-sectional view taken generally along section lines 3-3 of the dust collector of FIG. 2.

With reference to FIGS. 2 and 3, an upper end or air outlet 220 of the perforated tube 180 is in fluid communication with an air inlet section 222 of the air manifold 104 positioned above the first stage separator 150. The air manifold includes a bottom wall 226 and a top wall 228, which together at least partially define an air outlet section 230 provided under the cover unit 106. The top wall 228 includes a centrally located obconic or funnel-shaped portion 234. The funnel-shaped portion, together with the bottom wall 226, directs partially cleaned air from the perforated tube 180 to the second cyclonic stage 120.

More particularly, the second stage cyclone 120 comprises a plurality of spaced apart, frusto-conical, downstream, second stage cyclonic separators 250. These are of significantly smaller diameter than the first stage cyclone. The downstream separators are arranged in parallel and are mounted radially on the air manifold 104 at least partially above of the first cyclone part 118. The separators project downwardly from the bottom wall 226 at least partially into the upper collection section 130 of the second dust collection chamber 114. As shown in FIG. 3, each downstream separator 250 includes a dirty air inlet 252 in fluid communication with the air outlet section 230. In particular, the air outlet section is separated into a plurality of isolated air conduits 260 by a plurality of dividing walls 262 and 264. The dividing walls at least partially surround the dirty air inlet 252 of each downstream separator 250. Each manifold air conduit 260 has an air outlet 266 which directs a volume of partially cleaned air generally tangentially into the dirty air inlet 252 of each second stage separator 250. This causes a vortex-type, cyclonic or swirling flow. Such vortex flow is directed downwardly in the downstream separator since a top end thereof is blocked by the air manifold 104.

Each second stage or downstream separator 250 can have a dimensional relationship such that a diameter of its upper end can be about three times the diameter of its lower end. Further, as shown in FIG. 2, adjacent cyclones can have differing lengths. Such a construction is advantageous in order that the separated dirt exiting a downstream cyclone does not interfere with the separated dirt exiting an adjacent downstream cyclone. This reduces the risk of dirt collecting in the area of a particle outlet 268 of the downstream separator and being picked up by the vortex of an adjacent cyclone of the second stage. Also, such dirt could cause a blockage. These dimensional relationships improve the efficiency of cyclonic separation. An outer cover (not visible) can at least partially encase or surround the plurality of downstream separators 250. The outer cover can be secured to the dust collector 100 via conventional fastening means.

With reference again to FIG. 2, each downstream separator 250 includes a dust blocking member 270 having a connection member 272 and a dust blocking plate 274. The connecting member is mounted to a lower end 276 of each downstream separator 250. In this embodiment, an upper portion of the connecting member is integrally formed with the separator lower end; although, this is not required. The dust blocking plate 274 is attached to a lower portion of the connecting member so as to be spaced from the particle outlet 268 of the downstream separator 250 by a predetermined distance. The blocking plate limits turbulence in the second dust collection chamber 114 and prevents re-entrapment of dirt that has fallen into the second dust collection chamber into the cleaned air exiting each downstream separator. The lower end 276 of each second stage separator 250 and a bottom surface of the dust blocking plate 274 can be inclined at an acute angle, such as approximately fifteen degrees (15°) relative to a longitudinal axis of each separator. This configuration allows dirt to easily pass downwardly through the particle outlet 268 and into the second dust collection chamber 114, and also reduces the risk of dirt collecting in the area of the particle outlet and causing a blockage. The dirt separated by each downstream separator 250 is collected in the second dust collection chamber 114.

As shown in FIGS. 2 and 3, the air manifold 104 further includes a plurality of downwardly projecting discharge guide tubes 300. The discharge guide tubes direct cleaned air exhausted from the second cyclone part 120 into the cover unit 106 before being discharged to an inlet of an electric motor and fan assembly (not shown) of a vacuum cleaner. Each discharge guide tube 300 has a generally cylindrical shape and can include a laminar flow member to stop the air from circulating within the discharge tube. In the depicted embodiment, the laminar flow member is a generally cross-shaped baffle 304. However, it should be appreciated that other shapes are also contemplated. A portion of the baffle projects a predetermined distance from a lowermost end of each discharge guide tube into the interior of each downstream separator 250. The cross-sectional area of the baffle at any point along its length can be generally cross-shaped.

As shown in FIG. 2, the cyclone cover 106 includes a bottom plenum 310 and a top plenum 312. The bottom plenum can be hinged (not visible) to provide access to the second stage separators 250 for cleaning. The bottom plenum collects a flow of cleaned air from the downstream separators 250 and directs the cleaned air through a filter 320, for filtering any fine dust remaining in the airflow exiting the downstream separators. In this embodiment, the filter 320 comprises a two stage filter element and includes at least one foam filter. Such a filter can be a compound member with a coarse foam layer 322 and a fine foam layer 324 at least partially housed in the bottom plenum 210. The two foam layers can, if desired, be secured to each other by conventional means. Located downstream therefrom can be a pleated filter (not shown), such as a HEPA filter, housed in the top plenum 312. By housing the pleated filter in the cover unit 106, there is no need for an additional filter plenum and the foam filters are separated from the pleated filter. The filter 320 and the optional pleated filter can both be easily serviced by removing the top plenum from the bottom plenum. For example, the top plenum can be pivotally mounted to the bottom plenum. This separation of the filters prevents transfer of dust from the foam filter to the pleated filter during service. Of course, different filter constructions can also be employed.

The top plenum 312 collects a flow of cleaned air from the filter 320 and merges the flow of cleaned air into a cleaned air outlet conduit 330 (FIG. 1). An outlet end 332 of the cleaned air outlet conduit is in fluid communication with an inlet of a vacuum cleaner electric motor and fan assembly (not shown).

In operation, air entrained dirt passes into the upstream, first cyclone separator 110 through the inlet 152, which is oriented tangentially with respect to the sidewall 156 of the separator. The air then travels around the separation chamber where many of the particles entrained in the air are caused, by centrifugal force, to travel along the interior surface of the sidewall 156 of the separator 110 and drop out of the rotating air flow by gravity. However, relatively light, fine dust is less subject to a centrifugal force. Accordingly, fine dust may be contained in the airflow circulating near the bottom portion of the dirt cup. Since the cross blade 210 extends into the bottom portion of the first dust collection chamber 112 of the dirt cup 110, the circulating airflow hits the blade assembly and further rotation is stopped, thereby forming a laminar flow. In addition, if desired, extending inwardly from a bottom portion of the wall 138 of the first dust collection chamber 112 can be laminar flow members (not visible) which further prevent the rotation of air in the bottom of the dirt cup. As a result, most of the fine dust entrained in the air is also allowed to drop out.

The partially cleaned air travels through the openings 184 of the perforated tube 180. Thereafter, the partially cleaned air travels through the air manifold 104 and into the frusto-conical downstream cyclonic separators 250. There, the air cyclones or spirals down the inner surfaces of the cyclonic separators, separating out fine dust particles, before moving upward through the discharge guide tubes 300 and into the cover unit 106. The baffle 304 causes the air flowing through each discharge guide tube to have a laminar flow. Fine dirt separated in the downstream cyclonic separators collects in the second dust collection chamber 114. The cleaned air flows out of the downstream separators into the bottom plenum 310, through the filters 322 and 324, into the upper plenum 312 and into the cleaned air conduit 330. It will be appreciated that the volume of the bottom plenum can be generally the same as the volume of the upper plenum. The conduit 330 is in fluid communication with an air inlet to an electric motor and fan assembly. To empty the dirt collected in the dirt cup 110, once the dirt cup, or the entire dual cyclonic dust collector 100 is removed from the body of the vacuum cleaner, the lid 170 can be opened. At this point, the lid becomes accessible. In one embodiment, the dirt cup 110 can be selectively detached from the cyclone main body 102, to aid in emptying.

Similar to the aforementioned embodiment, a second embodiment of a dust collector for a vacuum cleaner is shown in FIGS. 4-11.

Figure 4:
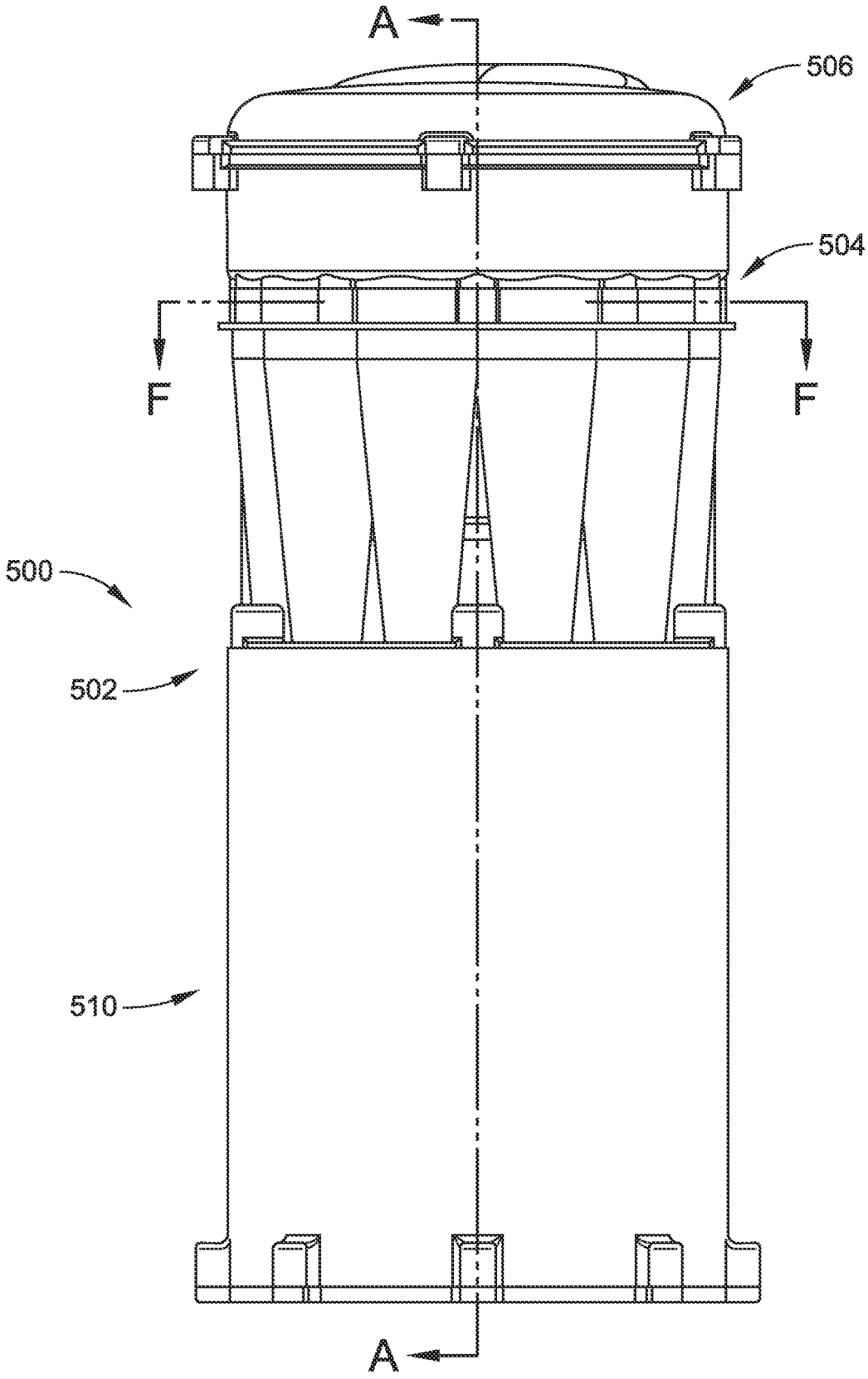
FIG. 4 is a front elevational view illustrating a dual cyclonic dust collector for a vacuum cleaner in accordance with another aspect of the present invention.

With reference to FIG. 4, the dust collector 500 includes a cyclone main body 502, an air manifold 504 and cover unit 506 attached to an upper portion of the cyclone main body, and a dirt cup 510 connected with a lower portion of the cyclone main body.

Figure 5:
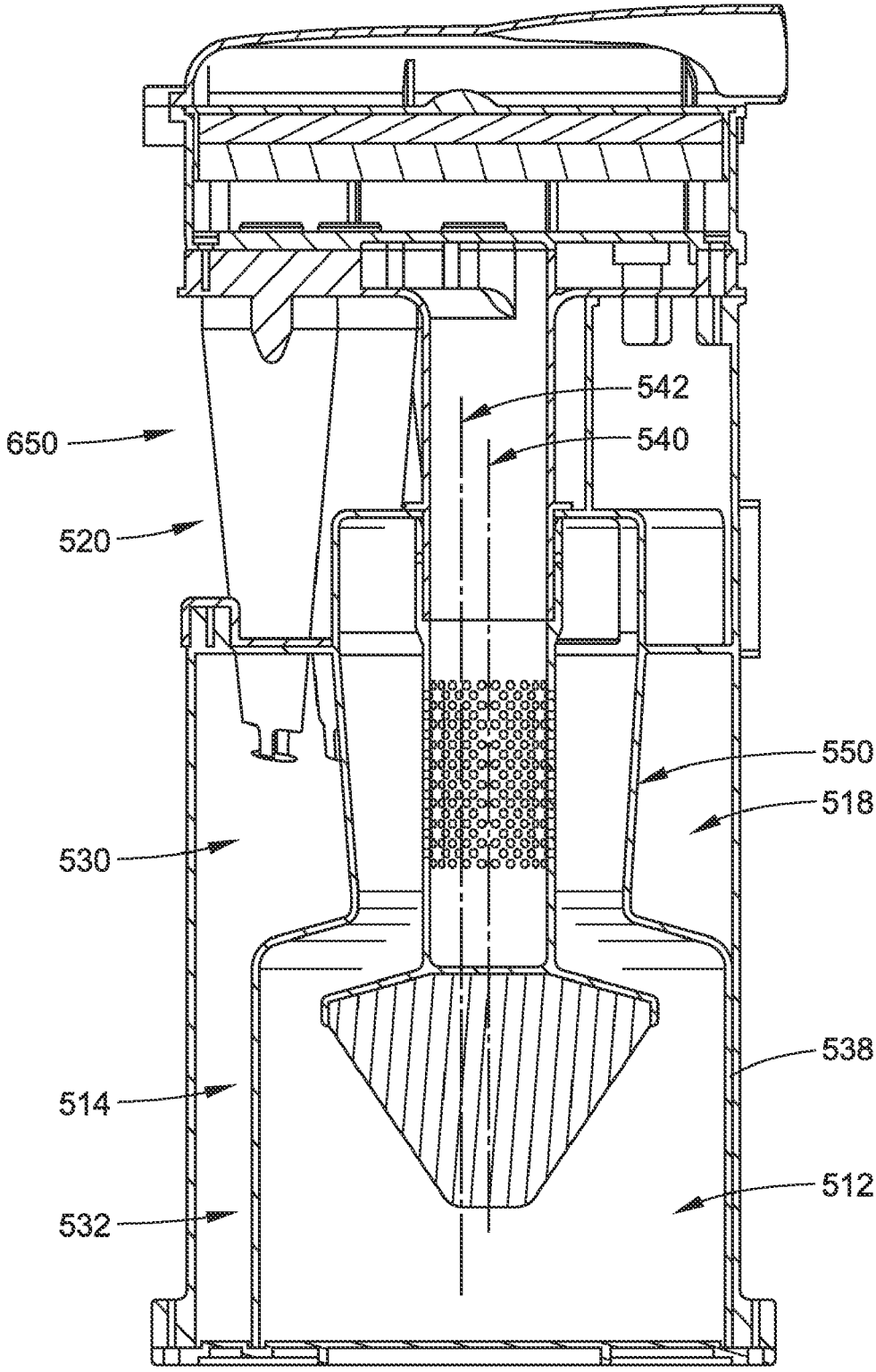
FIG. 5 is a cross-sectional view taken generally along section lines A-A of the dust collector of FIG. 4.
Figure 6:
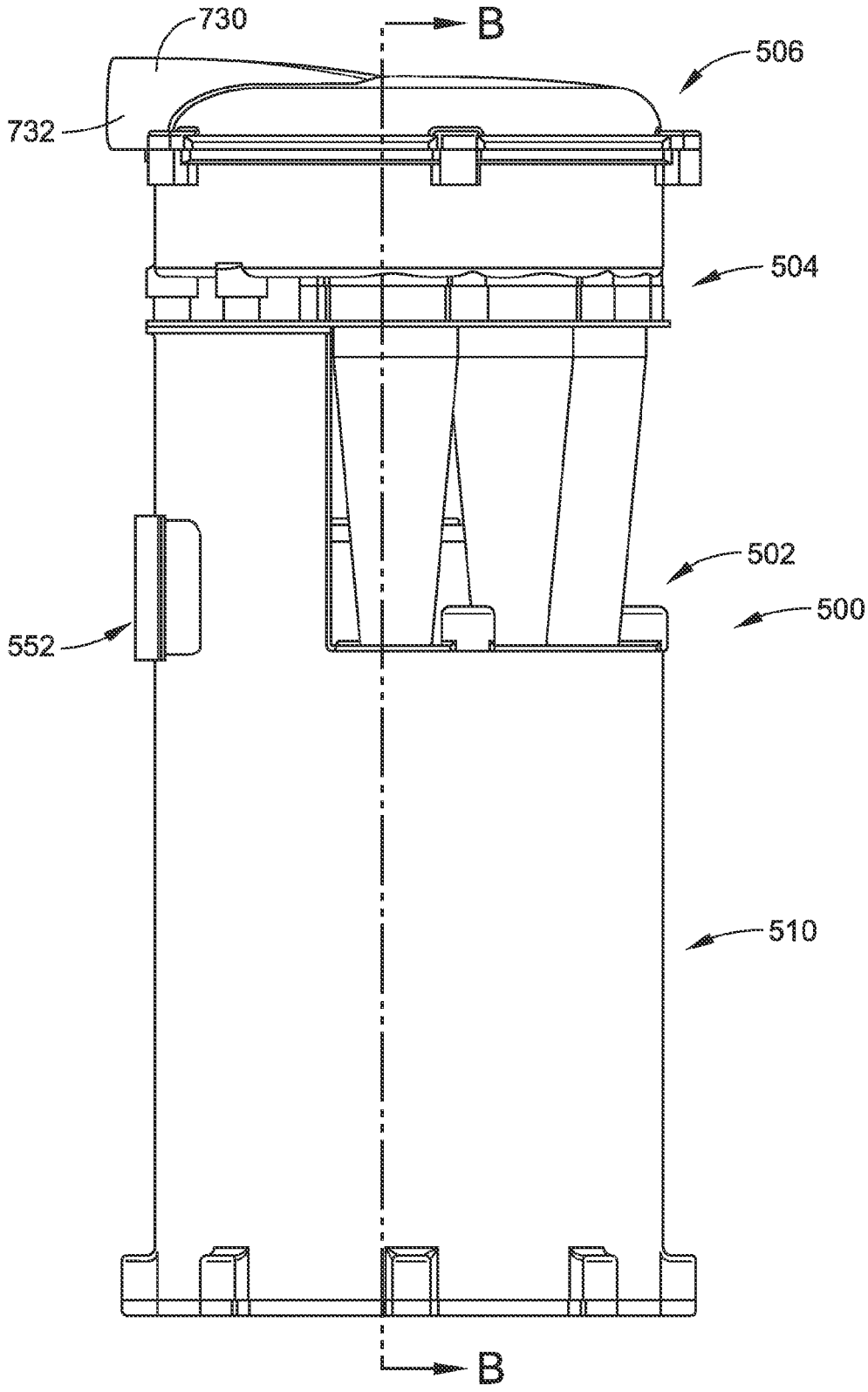
FIG. 6 is a side elevational view of the dust collector of FIG. 4.
Figure 7:
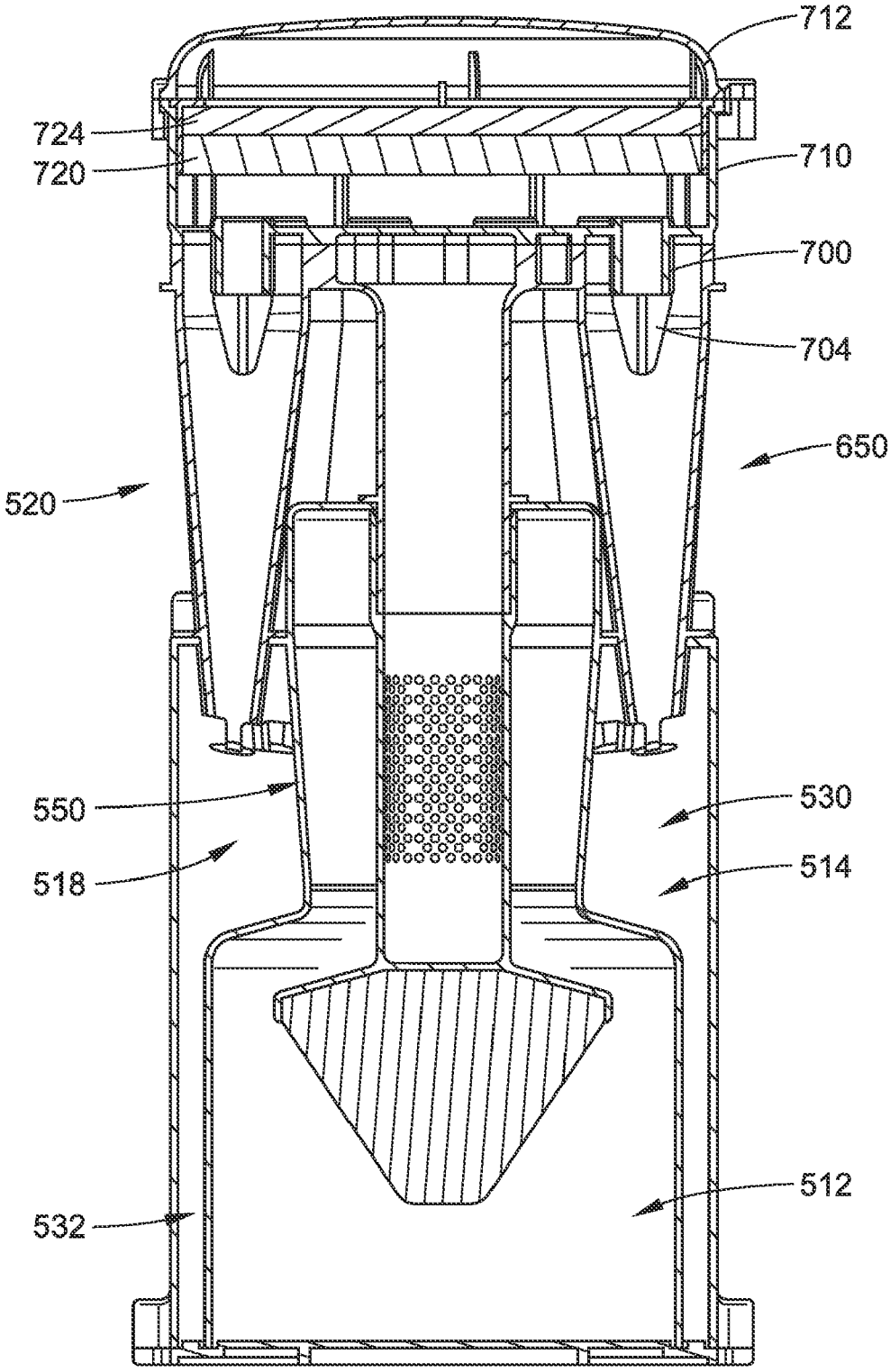
FIG. 7 is a cross-sectional view taken generally along section lines B-B of the dust collector of FIG. 6.

As shown in FIGS. 5 and 7, the dirt cup 510 includes a first dust collection chamber 512 and a second dust collection chamber 514. The cyclone main body 502 includes a first cyclone part or first cyclonic stage 518 and a second cyclone part or second cyclonic stage 520. The first and second dust collection chambers are configured to independently store dirt and dust particles separated by the respective first and second cyclone parts. The second dust collection chamber 514 includes an upper collection section 530 in communication with a lower collection section 532. The upper collection section 530 generally surrounds the first cyclone part 518. However, the lower collection section 532 is disposed only on one side of the first dust collection chamber 512. As shown in FIG. 5, because the lower collection section 532 only partially surrounds the first dust collection chamber 512, visibility of a sidewall 538 of the first dust collection chamber is not affected by fine dust particles collected in the second dust collection chamber 514. The first and second dust collection chambers are completely separated from each other such that the airflow in one of the chambers does not affect the airflow in the other of the chambers. This further improves the dust collection efficiency of the dust collector 500. As shown in FIG. 5, a longitudinal axis 540 defined by the first cyclone part 518 is offset from a longitudinal axis 542 defined by the dirt cup 510.

Figure 9:
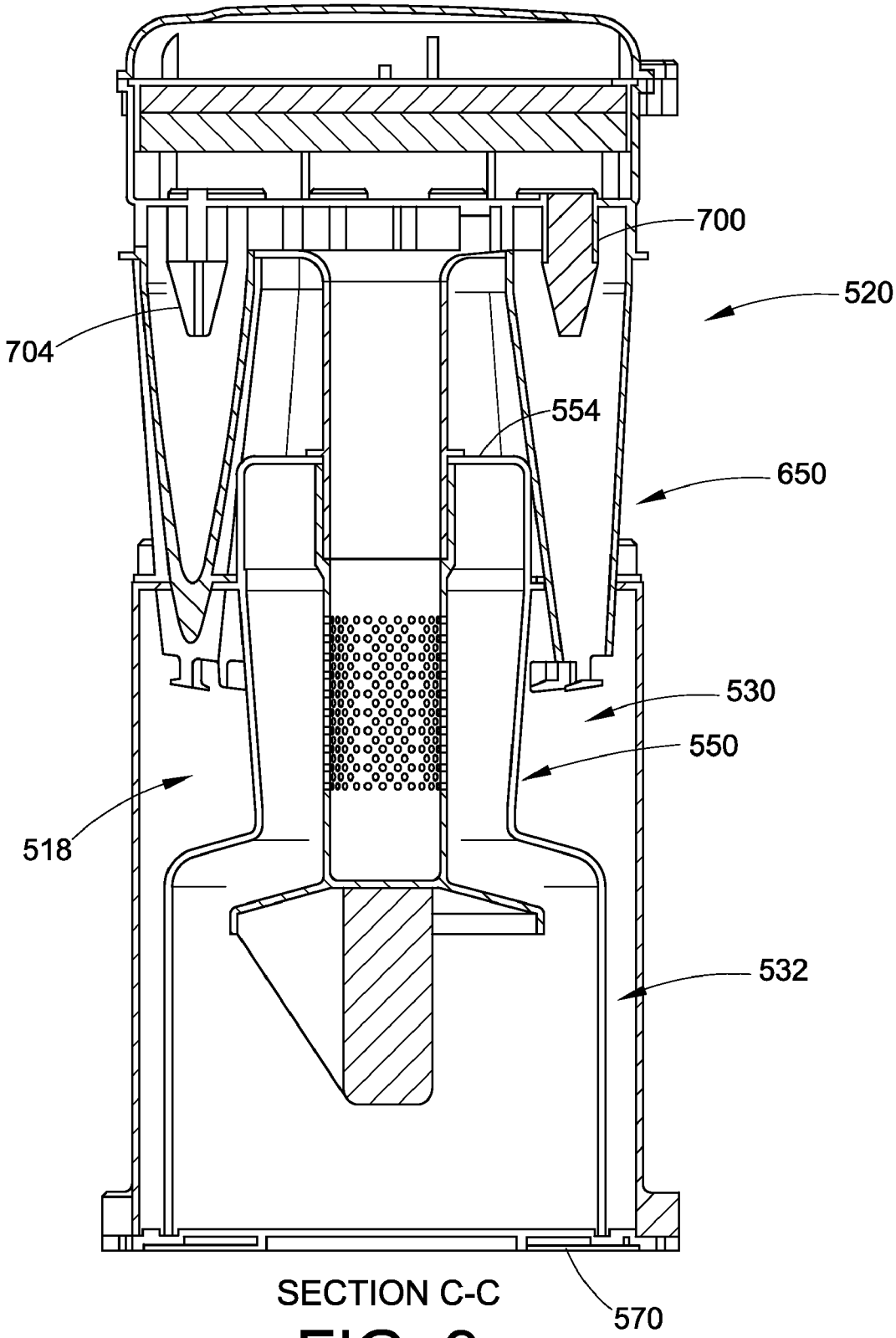
FIG. 9 is a cross-sectional view taken generally along section lines C-C of FIG. 8.
Figure 10:
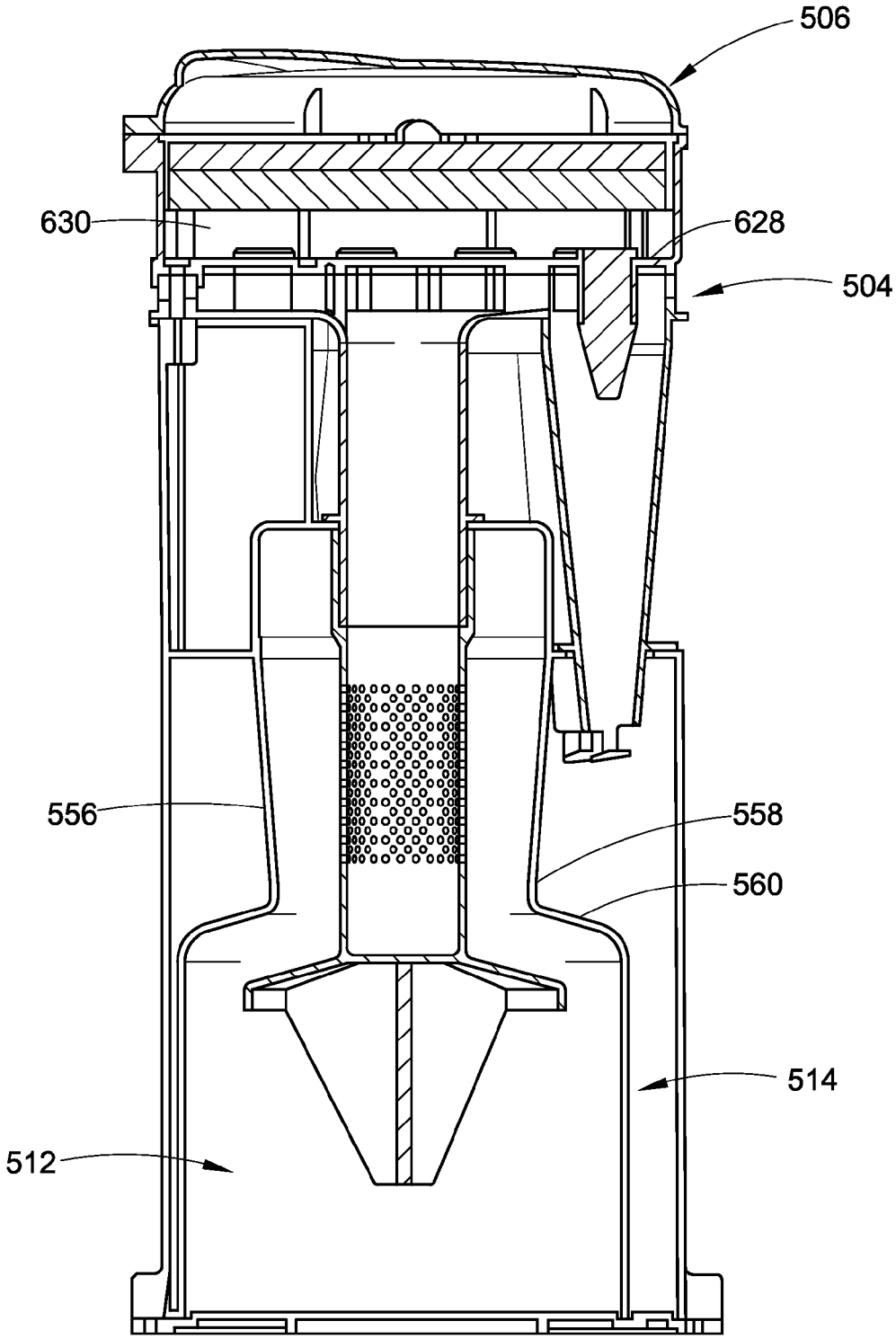
FIG. 10 is a cross-sectional view taken generally along section lines D-D of FIG. 8.
Figure 11:
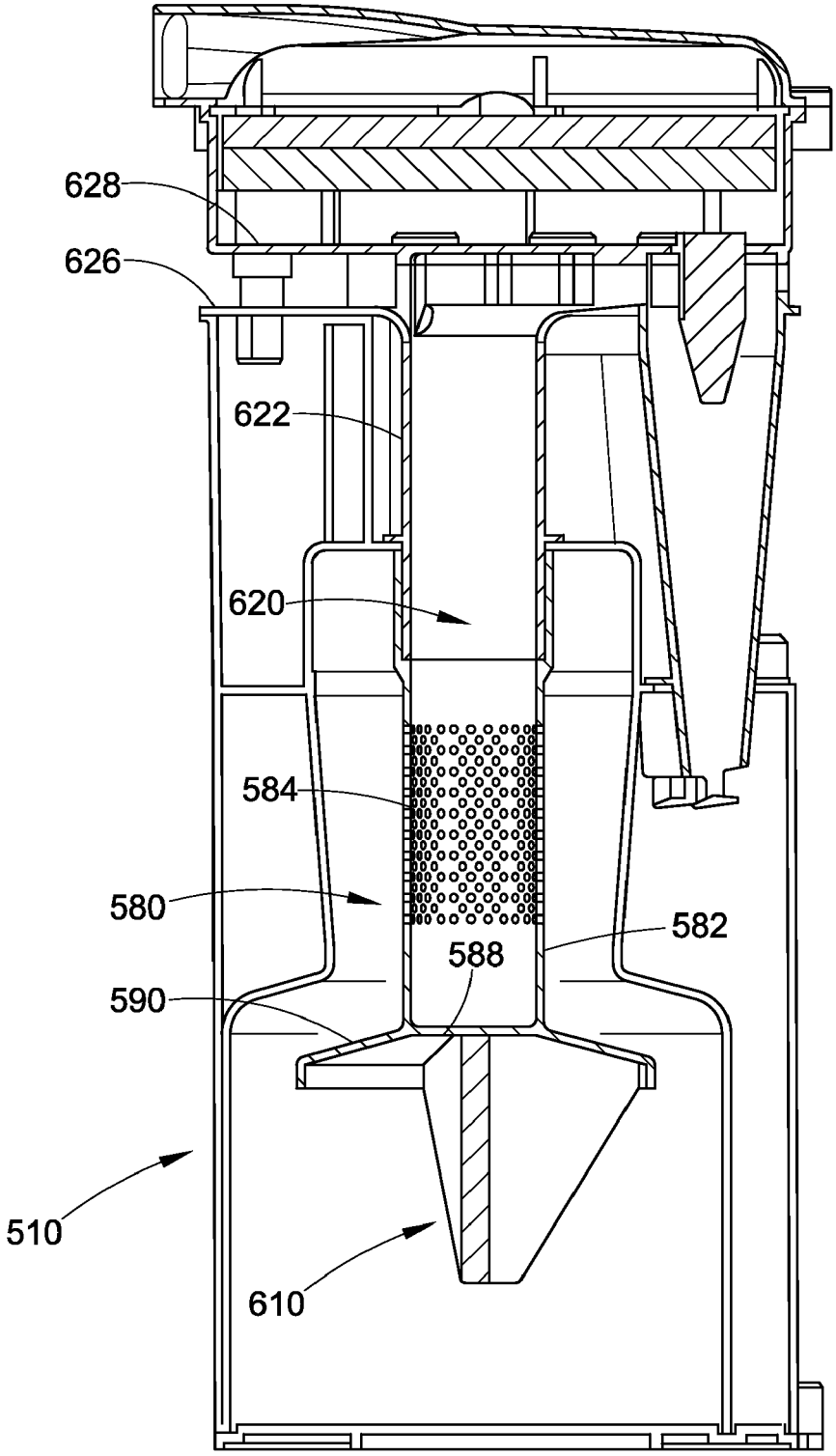
FIG. 11 is a cross-sectional view taken generally along section lines E-E of FIG. 8.

With reference now to FIGS. 9-11, the first cyclone part 518 comprises a generally frusto-conically shaped first stage cyclone separator 550. Although, it should be appreciated that the separator 550 can have a generally cylindrical shape. The first stage separator includes a dirty air inlet conduit 552 (FIG. 6), a top wall 554 and a sidewall 556 having an outer surface and an inner surface. A lower end 558 of the first stage cyclone separator is secured to a lower skirt 560. The skirt is tapered to promote sliding of the remaining dust particles separated by the second cyclone part 520 from the upper collection section 530 into the lower collection section 532. The dirty air inlet conduit 552 is in fluid communication with a nozzle assembly, which can include a brushroll (not shown), of a vacuum cleaner. The airflow into the first stage separator 550 is tangential which causes a vortex-type, cyclonic or swirling flow. Such vortex flow is directed downwardly in the first stage separator by the top wall 554. Cyclonic action in the first stage separator 550 removes a substantial portion of the entrained dust and dirt from the suction air stream and causes the dust and dirt to be deposited in the first dust collection chamber 512 of the dirt cup 510.

Pivotally secured to a lower portion of the dirt cup 510 is a bottom plate or lid 570. The pivotable bottom lid allows for emptying of the first and second dust collection chambers 512 and 514, respectively. This can occur once the dust collector 500, or at least the dirt cup 510 thereof, is removed from the body of the vacuum cleaner. A seal ring (not shown) can be fitted around the bottom lid to create a seal between the bottom lid and the dirt cup 510. A hinge assembly (not shown) can be used to mount the bottom lid 570 to a bottom portion of the dirt cup 510. The hinge assembly allows the bottom lid to be selectively opened so that dirt and dust particles that were separated from the air stream by the first and second stage cyclones 518 and 520, respectively, can be emptied from the first and second dust collection chambers. A latch assembly (not shown) can be located diametrically opposed from the hinge assembly. Normally, the latch assembly maintains the bottom lid 570 in a closed position.

Fluidly connecting the first cyclone part 518 to the second cyclone part 520 is a perforated tube 580. The perforated tube is removably disposed within the first stage separator 550 and extends longitudinally therein. In the depicted embodiment, the perforated tube has a longitudinal axis coincident with the longitudinal axis 540 of the first stage separator 550 and offset from the longitudinal axis 542 of the dirt cup 510. The perforated tube includes a generally cylindrical section 582. A plurality of openings or perforations 584 is located around the circumference of a portion of the length of the cylindrical section. The openings 584 serve as an outlet from the first stage separator 550, allowing the partially cleaned fluid to enter the second cyclone stage 520. Connected to a lower, closed end 588 of the perforated tube is a shroud 590 for retarding an upward flow of dirt and dust particles that have fallen below the lower end 558 of the first stage separator 550. A laminar flow member, such as one or more baffles or fins 610, is mounted to the closed lower end 588 of the perforated tube 580. At least a portion of the laminar flow member is encircled by the shroud 590.

Figure 8:
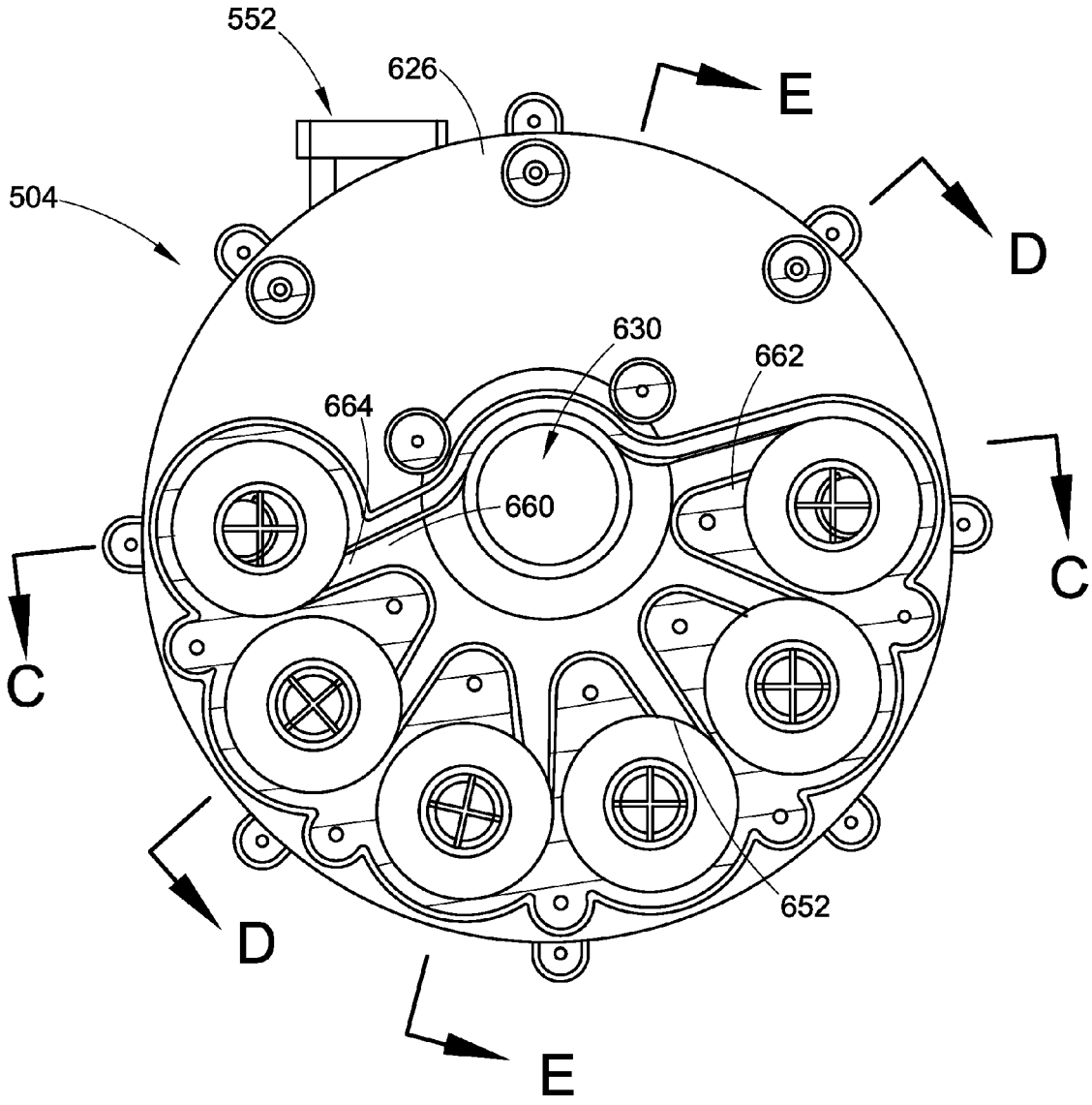
FIG. 8 is a cross-sectional view taken generally along section lines F-F of the dust collector of FIG. 4.

An upper end or air outlet 620 of the perforated tube 580 is in fluid communication with an air inlet section 622 of the air manifold 504 positioned above the first stage separator 550. With reference to FIG. 8, the air manifold includes a bottom wall 626. Such bottom wall and a wall 628 of the cover unit 506 together at least partially define an air outlet section 630 provided under the cover unit. The wall 628 together with the bottom wall 626 direct partially cleaned air from the perforated tube 580 to the second cyclonic stage 520.

With continued reference to FIGS. 8-11, the second stage cyclone 520 comprises a plurality of spaced apart, frusto-conical, downstream, second stage cyclonic separators 650. The downstream separators are arranged in parallel and are mounted radially on the air manifold 504 at least partially above of the first cyclone part 518. The separators project downwardly from the bottom wall 626 at least partially into the upper collection section 530 of the second dust collection chamber 514. Each downstream separator 650 includes a dirty air inlet 652 in fluid communication with the air outlet section 630. In particular, the air outlet section is separated into a plurality of isolated air conduits 660 by a plurality of dividing walls 662. The dividing walls at least partially surround the dirty air inlet 652 of each downstream separator 650. Each manifold air conduit 660 has an air outlet 664 which directs a volume of partially cleaned air generally tangentially into the dirty air inlet 652 of each second stage separator 650. This causes a vortex-type, cyclonic or swirling flow. Such vortex flow is directed downwardly in the downstream separator since a top end thereof is blocked by wall 628. Adjacent cyclones can have differing lengths (not shown).

As best shown in FIG. 7, the air manifold 504 further includes a plurality of downwardly projecting discharge guide tubes 700. The discharge guide tubes direct cleaned air exhausted from the second cyclone part 520 into the cover unit 506 before being discharged to an inlet of an electric motor and fan assembly of a vacuum cleaner. Each discharge guide tube 700 has a generally cylindrical shape and can include a laminar flow member 704 to stop the air from circulating within the discharge tube.

The cyclone cover 506 includes a bottom plenum 710 and a top plenum 712. The bottom plenum can be hinged (not visible) to provide access to the second stage separators 650 for cleaning. The bottom plenum collects a flow of cleaned air from the downstream separators 650 and directs the cleaned air through a first filter 720 and a second pleated filter 724, for filtering any fine dust remaining in the airflow exiting the downstream separators. The top plenum 712 collects a flow of cleaned air from the second filter 722 and merges the flow of cleaned air into a cleaned air outlet conduit 730. An outlet end 732 of the cleaned air outlet conduit is in fluid communication with an inlet of a vacuum cleaner electric motor and fan assembly.

Figure 12:
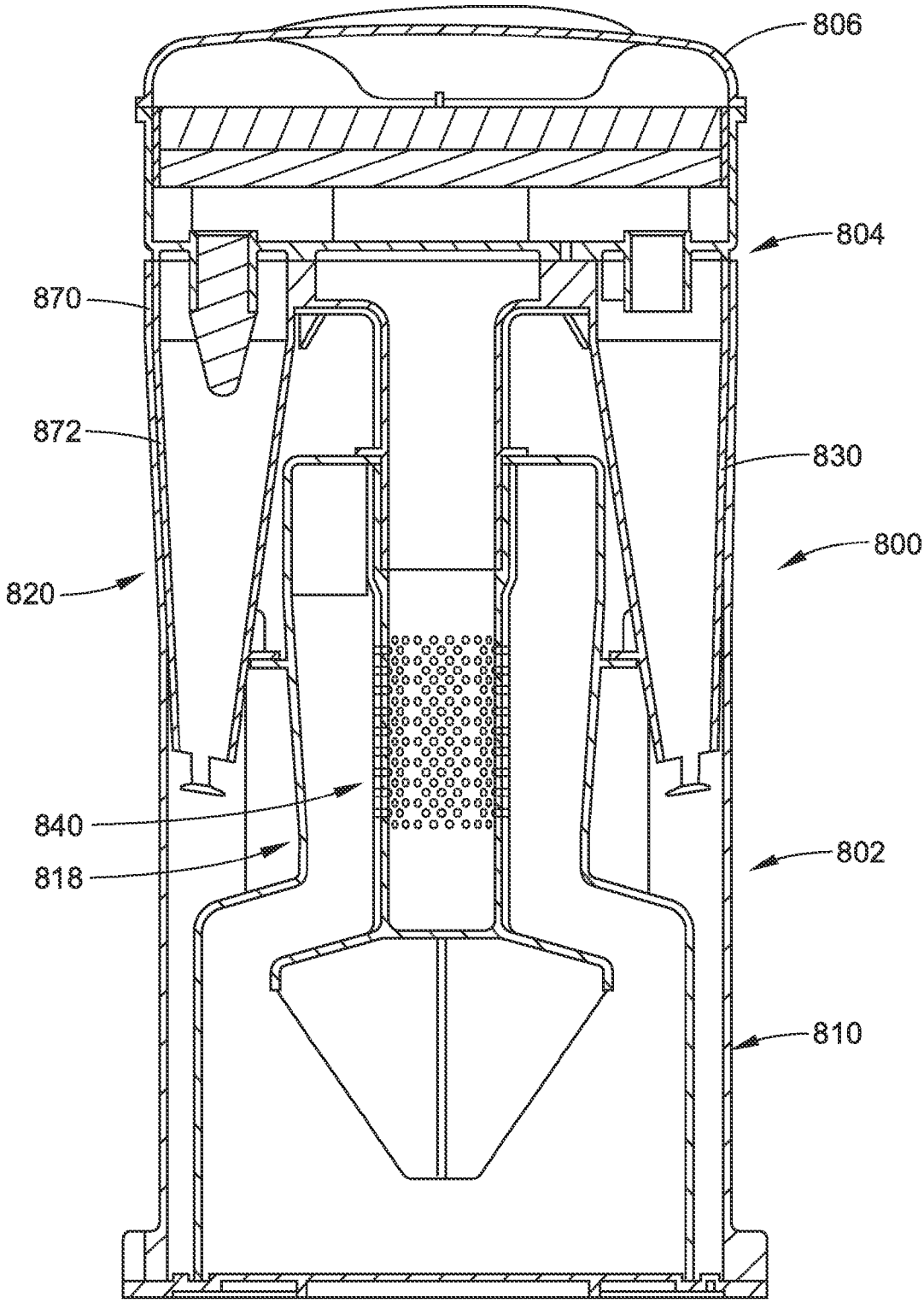
FIG. 12 is a cross-sectional view of a dual cyclonic dust collector for a vacuum cleaner according to a third embodiment of the present invention.
Figure 13:
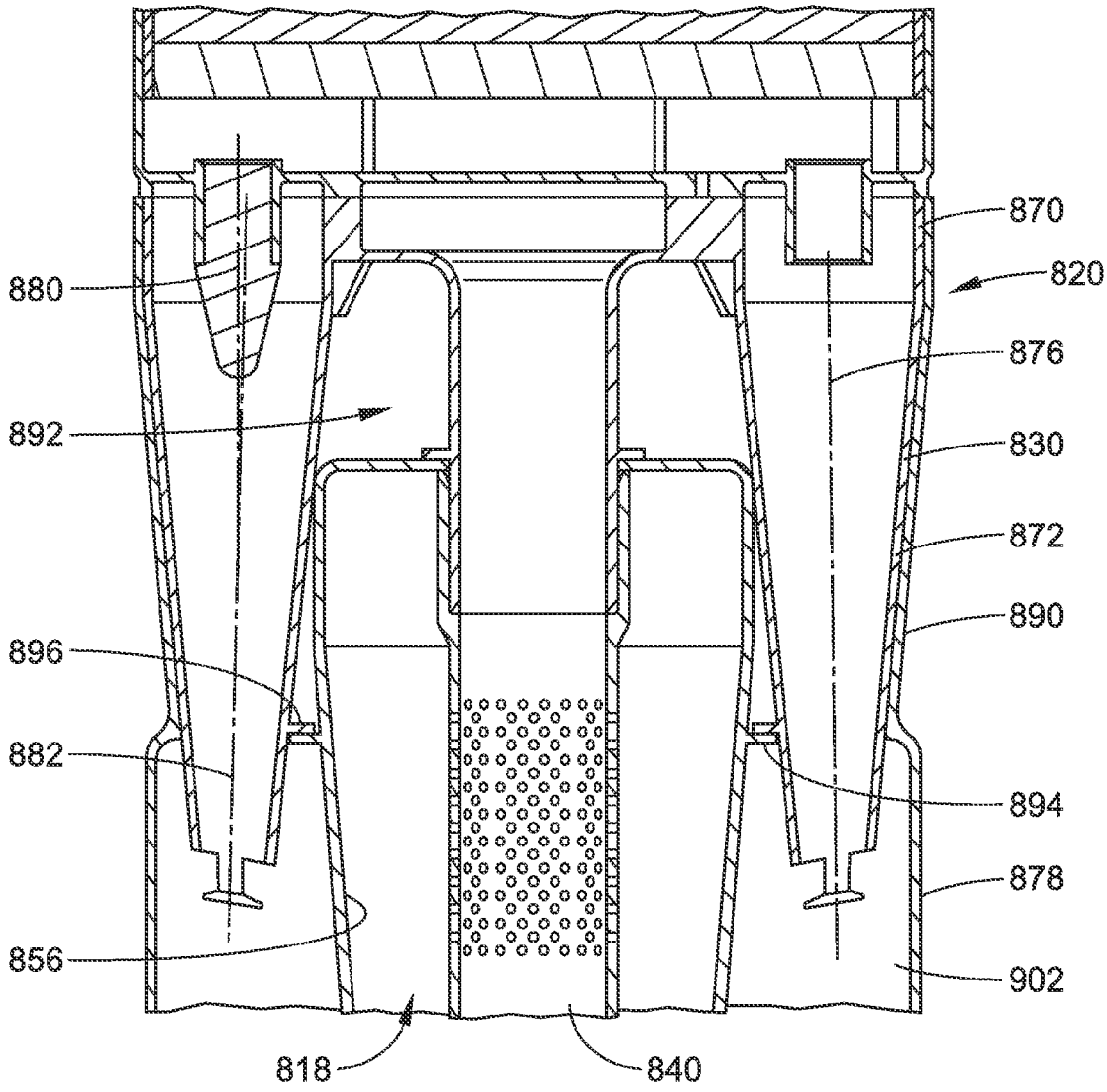
FIG. 13 is a partial cross-sectional view of the dual cyclonic dust collector of FIG. 12.
Figure 14:
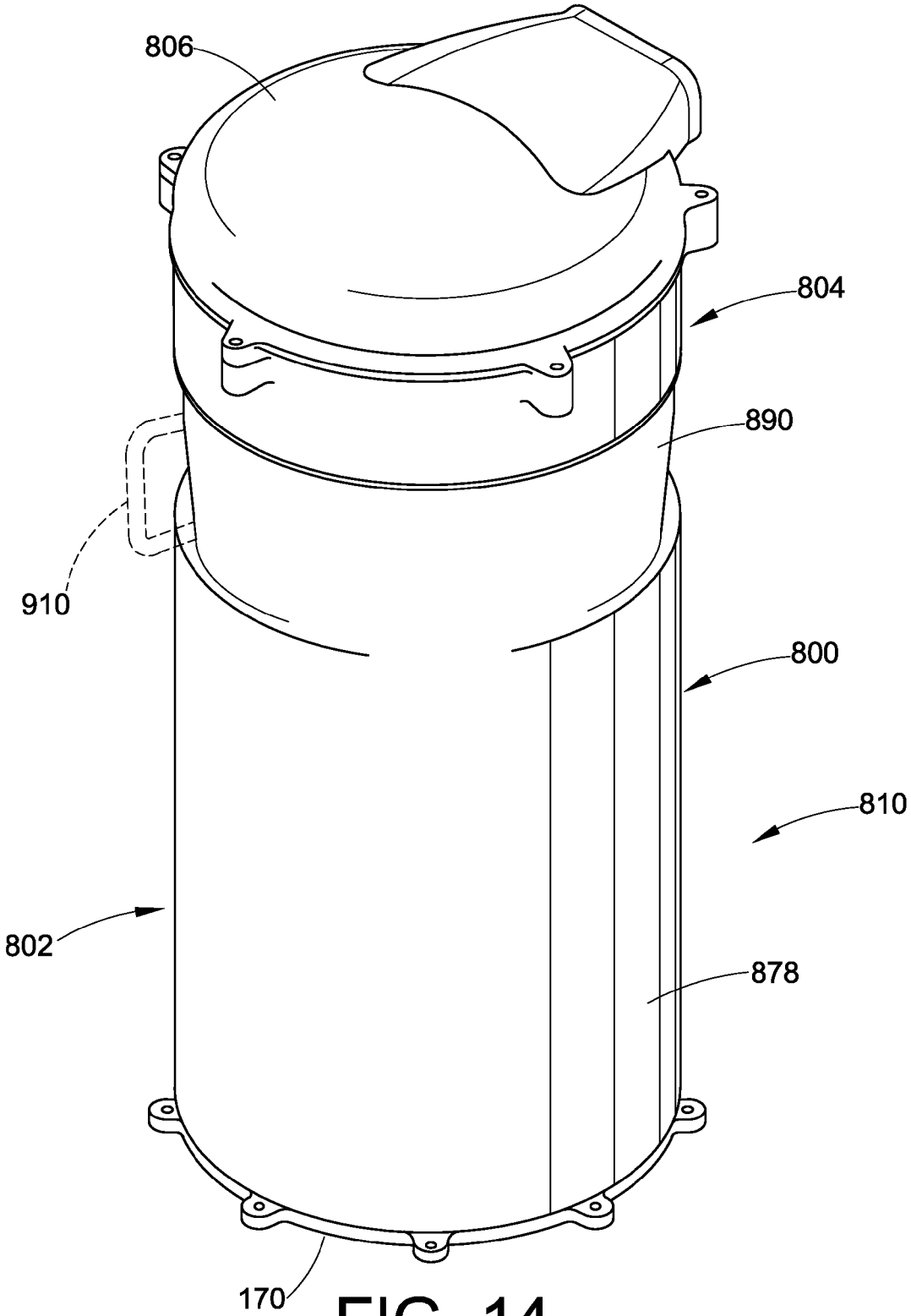
FIG. 14 is a front elevational view of the dual cyclonic dust collector of FIG. 12.

With reference now to FIGS. 12-14, a further embodiment of a dual cyclonic dust collector for a vacuum cleaner is illustrated. In this embodiment a dust collector 800 includes a cyclone main body 802, an air manifold 804, a cover unit 806 attached to an upper portion of the cyclone main body, and a dirt cup 810 connected to a lower portion of the cyclone main body. This embodiment includes a single upstream dirt separator or cyclonic stage 818 and a second, downstream, dirt separator or cyclonic stage 820 comprising a plurality of cyclones 830. A perforated tube 840 communicates an outlet of the first dirt separator with an inlet of the second dirt separator.

Each downstream separator 830 includes a cylindrical upper part 870 and a frusto-conical lower part 872 and defines a longitudinal axis. At least one downstream cyclone can have an inclined longitudinal axis 876 wherein the lower part extends outwardly toward a wall 878 of the dirt cup 810. This configuration provides a more compact dust collector 800 in the vertical direction, which allows the dust collector to be more easily packaged. In other words, by angling the axes of at least some of the second stage cyclones 830 outwardly, the height of the dust collector 800 can be reduced. This is advantageous for creating a more compact dust collector. In the depicted embodiment of FIG. 13, the upper part can define a first longitudinal axis 880 and the lower part can define a separate second longitudinal axis 882. The first longitudinal axis 880 is parallel to a longitudinal axis of the dirt cup 810 and the second longitudinal axis 882 is inclined such that the first and second axes define an acute angle.

Figure 15:
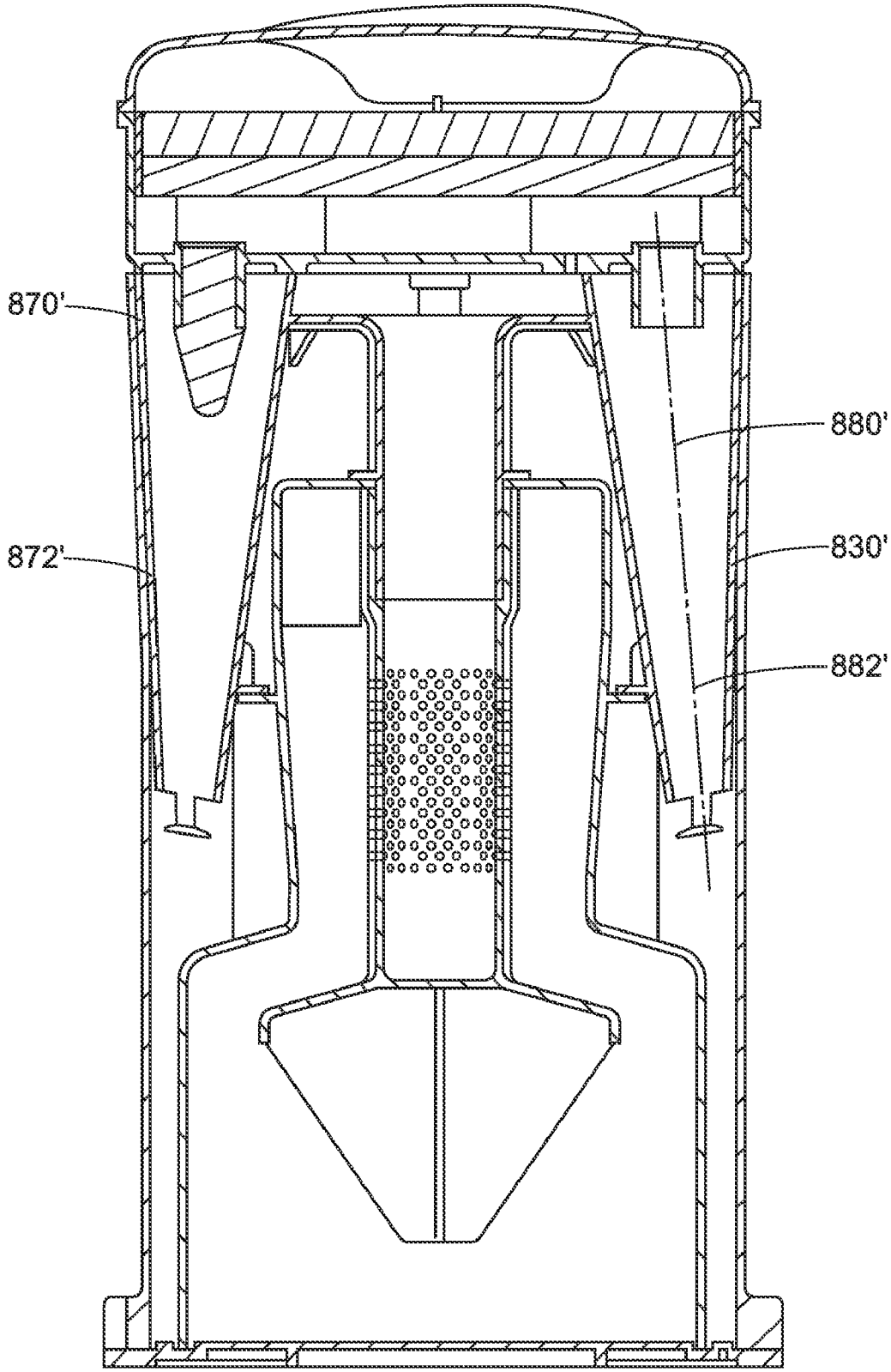
FIG. 15 is a cross-sectional view of a dual cyclonic dust collector for a vacuum cleaner according to a fourth embodiment of the present invention.

Alternatively, as shown in FIG. 15, each downstream separator 830' includes a frusto-conical upper part 870' and a frusto-conical lower part 872'. The upper part can define a first longitudinal axis 880' and the lower part can define a separate second longitudinal axis 882'. The second longitudinal axis is generally coincident with the first longitudinal axis, and both the first and second longitudinal axes are outwardly inclined.

As shown in FIGS. 12 and 13, the plurality of downstream separators 830 can be encased or surrounded by a wall 890 having an upper end secured to the cover unit 806 and a lower end secured to the wall 878 of the dirt cup. The wall 890 is integrally formed with the dirt cup wall; although, this is not required. The wall 890 can have a tapered configuration, although, it should be appreciated that the wall can have an outer surface contiguous with an outer surface of the dirt cup wall. To prevent fine dust particles from entering into the space 892 defined by the wall 890, a portion of the wall touches the downstream separators 830. A flange 894 extends outwardly from a sidewall 856 of the first stage separator 818. Each downstream separator includes a tab 896 which abuts the flange, the tab being longitudinally positioned on the separator so that the separator projects least partially into an upper collection section 902 of a second dust collection chamber. The engagement between the flange and the tab, together with the wall 890, effectively seals the space 892. In this embodiment, a handle 910 is shown as being secured to the dust collector 800. Such a handle is advantageous in the handling of the dust collector as it is removed from the body of a vacuum cleaner (not shown) for emptying of the dirt cup 810.

Several embodiments of a dual cyclonic dust collector have been described herein. Obviously, modifications and alterations will occur to others upon reading and understanding the preceding detailed description. It is intended that the illustrated embodiments be construed as including all such modifications and alterations, insofar as they come within the scope of the appended claims or the equivalents thereof.

What is claimed is:

1. An electrically powered surface care appliance comprising:

a nozzle body, including a main suction opening;

a housing in air flow communication with the main suction opening of the nozzle body and including an airstream suction source mounted to the housing and including a suction airstream inlet and a suction airstream outlet, the suction source electrically powered to selectively establish and maintain a flow of air from the main suction opening to the airstream outlet;

a cyclonic particle separation main body mounted to the housing and in communication with the main suction opening, the cyclonic main body including a first stage cyclonic separator including a shroud, and a laminar flow member connected to the shroud, at least a portion of the laminar flow member being encircled by the shroud, wherein the shroud includes a first portion having a first dimension and a second portion having a second greater dimension, the configuration of the shroud positioning the laminar flow member centrally within the first stage cyclonic separator, and a plurality of second stage cyclonic separators spaced apart and in communication with the first stage cyclonic separator, each second stage cyclonic separator defining an inlet substantially adjacent a top of the second stage cyclonic separator, a dirt outlet substantially at a bottom of the second stage cyclonic separator, and an air outlet substantially adjacent the top of the second stage cyclonic separator, wherein the dirt outlets of two adjacent second stage cyclonic separators are positioned at different heights with respect to the first stage cyclonic separator; and a dirt cup connected to the cyclonic main body for collecting particles separated by the first stage cyclonic separator and the plurality of second stage cyclonic separators.

2. The appliance of claim 1 wherein a majority of the plurality of second stage cyclonic separators have dirt outlets positioned at different heights relative to the dirt outlets of adjacent second stage cyclonic separators.

3. The appliance of claim 1 wherein each dirt outlet of the plurality of second stage cyclonic separators is positioned at a different height relative to the dirt outlet of at least one adjacent second stage cyclonic separator.

4. The appliance of claim 1, wherein the dirt cup comprises a first particle collector communicating with the first separator for collecting coarse dust particles and has a bottom emptying panel.

5. The appliance of claim 1, further comprising a perforated tube disposed within the first stage separator for fluidly connecting the first stage separator to the plurality of second stage separators, the perforated tube including a longitudinal axis generally coincident with the longitudinal axis of the first stage separator.

6. The collector of claim 1, wherein at least one second stage cyclonic separator includes a cylindrical upper part and a frusto-conical lower part, the at least one second stage cyclonic separator defining a longitudinal axis, the longitudinal axis being inclined wherein the lower part extends outwardly relative to the upper part.

7. The collector of claim 6, wherein the upper part defines a first longitudinal axis and the lower part defines a second longitudinal axis, the first and second longitudinal axes defining an acute angle.

8. The appliance of claim 1, wherein the dirt cup includes a) a first particle collector communicating with the first stage separator for collecting dust particles from the first stage separator, and b) a separate second particle collector communicating with the plurality of second stage separators for collecting dust particles from the second stage separators.

9. The cleaning appliance of claim 8, wherein the dirt cup has a common bottom panel to empty both the first and the second particle collectors.

10. The cleaning appliance of claim 8, wherein the first particle collector includes an inner wall portion which at least partially defines the second particle collector, the inner wall portion being generally curved toward the second particle collector such that the first particle collector has a non-constant radius, wherein the dirt cup has a generally constant radius.

11. The cleaning appliance of claim 8, wherein the first and second particle collectors are configured to empty independently of each other.

12. The cleaning appliance of claim 8, wherein the first and second particle collectors are configured to be simultaneously emptied.

13. The cleaning appliance of claim 8, wherein the plurality of second stage separators are arranged in parallel and mounted radially outside of the first stage separator, an uppermost end of each second stage separator being located approximately in a plane defined by a top wall of the first stage separator.

14. The cleaning appliance of claim 8, wherein the second particle collector is at least partially defined by a wall of the first stage separator and a wall of the cyclone main body, the plurality of downstream separators being surrounded by the wall of the cyclone main body.

15. The cleaning appliance of claim 8, wherein a wall of the first stage separator and a wall of the cyclone main body together at least partially define the second particle collector.

16. An electrically powered surface care appliance comprising:

a nozzle body, including a main suction opening;

a housing in air flow communication with the main suction opening of the nozzle body and including an airstream suction source mounted to the housing and including a suction airstream inlet and a suction airstream outlet, the suction source electrically powered to selectively establish and maintain a flow of air from the main suction opening to the airstream outlet;

a cyclonic particle separation main body mounted to the housing and in communication with the main suction opening, the cyclonic main body including a first stage cyclonic separator, and a plurality of second stage cyclonic separators spaced apart and in communication with the first stage cyclonic separator, each second stage cyclonic separator defining an inlet substantially adjacent a top of the second stage cyclonic separator, a dirt outlet substantially at a bottom of the second stage cyclonic separator, and an air outlet substantially adjacent the top of the second stage cyclonic separator, wherein the dirt outlets of two adjacent second stage cyclonic separators are positioned at different heights with respect to the first stage cyclonic separator; and a dirt cup connected to the cyclonic main body and including a first particle collector communicating with the first stage separator for collecting dust particles from the first stage separator, and a separate second particle collector communicating with the plurality of second stage separators for collecting dust particles from the second stage separators, wherein the second particle collector is at least partially defined by a wall of the first stage separator and a wall of the cyclone main body, the plurality of downstream separators being surrounded by the wall of the cyclone main body.

17. An electrically powered surface care appliance comprising:

a nozzle body, including a main suction opening;

a housing in air flow communication with the main suction opening of the nozzle body and including an airstream suction source mounted to the housing and including a suction airstream inlet and a suction airstream outlet, the suction source electrically powered to selectively establish and maintain a flow of air from the main suction opening to the airstream outlet;

a cyclonic particle separation main body mounted to the housing and in communication with the main suction opening, the cyclonic main body including a first stage cyclonic separator, and a plurality of second stage cyclonic separators spaced apart and in communication with the first stage cyclonic separator, each second stage cyclonic separator defining an inlet substantially adjacent a top of the second stage cyclonic separator, a dirt outlet substantially at a bottom of the second stage cyclonic separator, and an air outlet substantially adjacent the top of the second stage cyclonic separator, wherein the dirt outlets of two adjacent second stage cyclonic separators are positioned at different heights with respect to the first stage cyclonic separator; and a dirt cup connected to the cyclonic main body and including a first particle collector communicating with the first stage separator for collecting dust particles from the first stage separator, and a separate second particle collector communicating with the plurality of second stage separators for collecting dust particles from the second stage separators, wherein a wall of the first stage separator and a wall of the cyclone main body together at least partially define the second particle collector.

* * * * *